US011434110B2

(12) United States Patent
Cranston

(10) Patent No.: US 11,434,110 B2
(45) Date of Patent: Sep. 6, 2022

(54) HOOK WITH PNEUMATIC CONTROL CIRCUIT SAFETY RELIEF

(71) Applicant: Cranston Diversified Industries, Inc., Oak Grove, OR (US)

(72) Inventor: Edward C. Cranston, Oak Grove, OR (US)

(73) Assignee: Cranston Diversified Industries, Inc., Oak Grove, OR (US)

( * ) Notice: Subject to any disclaimer, the term of this patent is extended or adjusted under 35 U.S.C. 154(b) by 0 days.

(21) Appl. No.: 17/165,815

(22) Filed: Feb. 2, 2021

(65) Prior Publication Data

US 2021/0253401 A1 Aug. 19, 2021

Related U.S. Application Data

(60) Provisional application No. 62/976,206, filed on Feb. 13, 2020.

(51) Int. Cl.
*B66C 1/36* (2006.01)

(52) U.S. Cl.
CPC ..... *B66C 1/36* (2013.01)

(58) Field of Classification Search
CPC . B66C 1/34; B66C 1/36; F16B 45/043; F16B 45/045
USPC ..... 294/82.19, 82.3, 82.31, 82.34, 81.56
See application file for complete search history.

(56) References Cited

U.S. PATENT DOCUMENTS 3,310,335 A * 3/1967 Shuey ..... B66C 3/16 294/198
3,730,484 A * 5/1973 Fairbanks ..... B66C 13/16 254/264
3,957,234 A 5/1976 Mulvey et al.
4,095,833 A 6/1978 Lewis
4,193,627 A 3/1980 Cranston et al.
4,416,480 A 11/1983 Moody
4,530,535 A 7/1985 Hargreaves
5,178,427 A 1/1993 Jorritsma
5,636,888 A 6/1997 Kiser et al.
7,488,019 B2 * 2/2009 Molaug ..... B66C 1/38 294/82.31
2005/0127695 A1 6/2005 Cranston et al.

FOREIGN PATENT DOCUMENTS

KR 101706571 B1 2/2017
WO WO2012/018692 2/2012

OTHER PUBLICATIONS

Elebra, "Fail-safe Design: Safety," https://elebia.com/fail-safe-design/ (downloaded Aug. 15, 2019).

(Continued)

*Primary Examiner* — Dean J Kramer
(74) *Attorney, Agent, or Firm* — Klarquist Sparkman, LLP

(57) ABSTRACT

A load lifting hook assembly includes a body, a hook coupled to the body, a fluid connection on the body and connectable to a pressurized fluid source, a piston and a pressure relief valve. The piston is extendable from the body to engage the hook and lock the hook in a closed position relative to the body. The piston is configured to receive pressurized fluid from the fluid connection tending to urge the piston out of engagement with the hook. The pressure relief valve is positioned in the body in communication with the fluid connection and configured to prevent excess pressure in the pressurized fluid from acting on the piston.

20 Claims, 7 Drawing Sheets

(56) References Cited

OTHER PUBLICATIONS

Integrated Publishing, "External Cargo Hook System Schematic-Hook Release Modes," http://ch-47helicopters.tpub.com/TM~55-1520-240-T-3/css/TM-55-1520-240-T-3_835.htm (downloaded Aug. 15, 2019).
United States Army Warfighting Center, "CH-47D Cargo Handling Systems," Student Handout, File No. 011-2115-3 (Nov. 2006).

* cited by examiner

HOOK WITH PNEUMATIC CONTROL CIRCUIT SAFETY RELIEF

CROSS REFERENCE TO RELATED APPLICATION

This application claims the benefit of U.S. Provisional Patent Application No. 62/976,206, filed Feb. 13, 2020, which is hereby incorporated by reference.

BACKGROUND

This application relates to hooks used in lifting loads, and in particular, to remote controlled hooks used in lifting and maneuvering heavy loads.

Hooks are used in lifting applications for general construction, fishing, logging, cargo handling, foundry work, forest products, mining, agriculture, and other industries. In some situations, there are advantages to providing a hook that can be controlled remotely, e.g., so as not to require an operator to directly handle the hook during one or more of the steps associated with a lifting operation. Examples of remote-controlled hooks are described in commonly owned U.S. Pat. Nos. 4,095,833, 4,193,627 and 4,530,535, which are incorporated herein by this reference.

One common lifting application is cargo handling, which includes the lifting of cargo into and out of ships using a crane. Typically, hooks for lifting cargo are attached to strapping, webbing, wire and/or other type of slinging arrangement arranged around the cargo. The hooks may be used in groups that are suspended from a lifting frame and/or crane, usually by lifting chains. The hooks are engaged with the slings, usually by hand. Typically, the hooks are locked in a closed position, and the operator then engages the sling by passing it through to the throat of the hook, which may involve depressing a spring-loaded latch extending over the hook gap. It is also possible to lock the hook in place after the slings are received in the hook throat.

After the cargo is lifted and transported, it is desirable to release or unlock the hook remotely, preferably without requiring personnel to be in the direct area of the hooks to manually release them. Conventional cargo hooks are pneumatically controllable to be released or "unlocked" from the closed position to an open position in which the hook can freely pivot, and will usually be released from the sling without handling by an operator when the cable or chain to which the hook is attached is raised.

In some scenarios, conventional hook control systems and conventional hooks are capable of operation outside of specified design parameters, which can lead to changes in operation, injury, damage and the need for premature servicing of hooks and other lifting equipment.

SUMMARY

Described below are implementations of a load lifting hook and load lifting hook systems that address drawbacks of conventional load lifting hooks and load lifting hook systems.

In some implementations, a load lifting hook assembly includes a body, a hook coupled to the body, a fluid connection on the body, a piston and a pressure relief valve in the body. The fluid connection is connectable to a pressurized fluid source. The piston is extendable from the body to engage the hook and lock the hook in a closed position relative to the body. The piston is configured to receive pressurized fluid from the fluid connection that tends to urge the piston out of engagement with the hook. The pressure relief valve is positioned in communication with the fluid connection and configured to prevent excess pressure in the pressurized fluid from acting on the piston.

The piston can spring-biased to an extended position, and the hook can include a recess shaped to receive the piston when the hook is in a closed position.

The hook can include a hook body having a base, a hook pivot axis and a distal free end defining a hook point, and the pressure relief valve can be positioned in the body opposite the hook point when the hook is in the closed position. The hook body can include a hook throat extending from the hook point and across a gap between the hook point and the base of the hook. The body can include a pivotable latch extending away from the body and towards the hook point when the hook is in the closed position. The pressure relief valve can be positioned adjacent the pivotable latch.

The body of the hook can include a passageway, and the pressure relief valve can be secured within the passageway with a retaining member. The body can define a body axis and a bore along the body axis dimensioned to receive the piston.

The pressure relief valve can include a spring member. The pressure relief valve can be configured to vent excess pressure above a predetermined pressure, e.g., above a pressure from 20-40 psi., through an opening in the body to a surrounding area.

The hook can be pivotably coupled to the body. Alternatively, the hook can be fixedly coupled to the body.

The hook can include a swivel arrangement coupled to one end of the body. The hook can include a top cap removably secured to the body. The hook can include a swivel screw extending from the top cap and connecting to an exterior swivel.

In another implementation, a load lifting hook system includes one or more load lifting hooks, at least one manifold, a solenoid valve, a pressurized fluid source, a regulator and a pressure relief valve. The manifold is configured to supply at least two of the multiple load lifting hooks with pressurized fluid via an individual conduit extending to a fluid connection on a body of each load lifting hook, respectively. The solenoid valve is positioned upstream of the at least one manifold. The pressurized fluid source provides a source of pressurized fluid. The regulator is positioned downstream of the pressurized fluid source. The regulator is adjustable to adjust a supply pressure of the pressurized fluid supplied by the pressurized fluid source. The pressure relief valve is positioned at each of the multiple load lifting hooks and remote from the regulator. The pressure relief valve is selectively configured to vent excess pressure above a predetermined limit pressure that is independent of the supply pressure set by the regulator.

The pressure relief valve can be housed within the body of each load lifting hook in communication with the fluid connection. The pressure relief valve can be secured in the body with a tamper resistant arrangement. The pressure relief valve can be non-adjustable.

The foregoing and other objects, features, and advantages of the invention will become more apparent from the following detailed description, which proceeds with reference to the accompanying figures.

DETAILED DESCRIPTION

Figure 1:
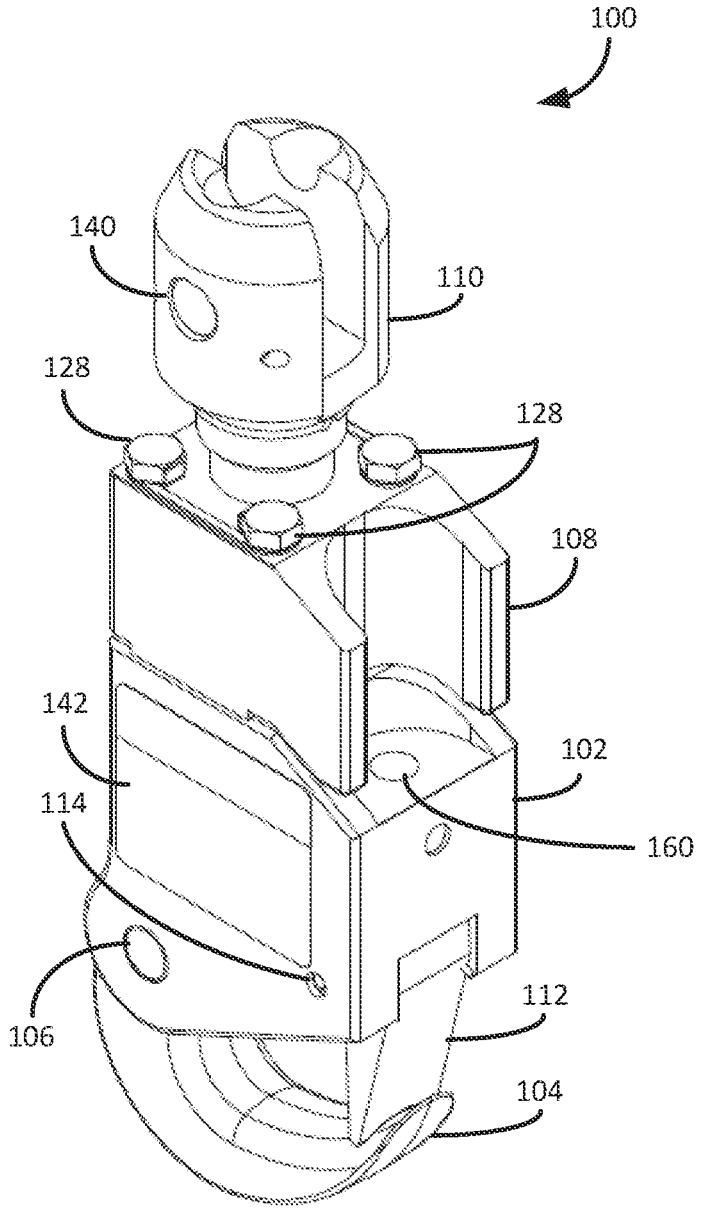
FIG. 1 is a perspective view of a load lifting hook according to one implementation, which is shown in isolation.
Figure 2:
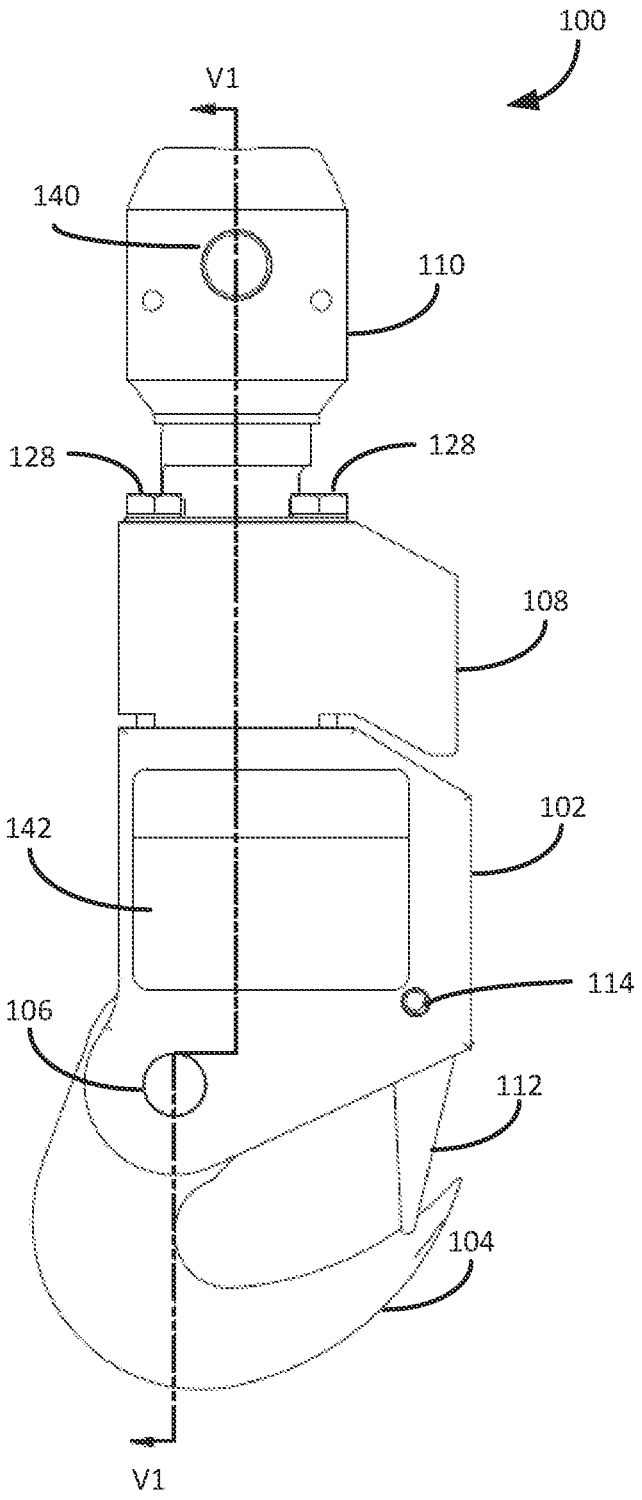
FIG. 2 is a right side elevation view of the load lifting hook of FIG. 1.
Figure 3:
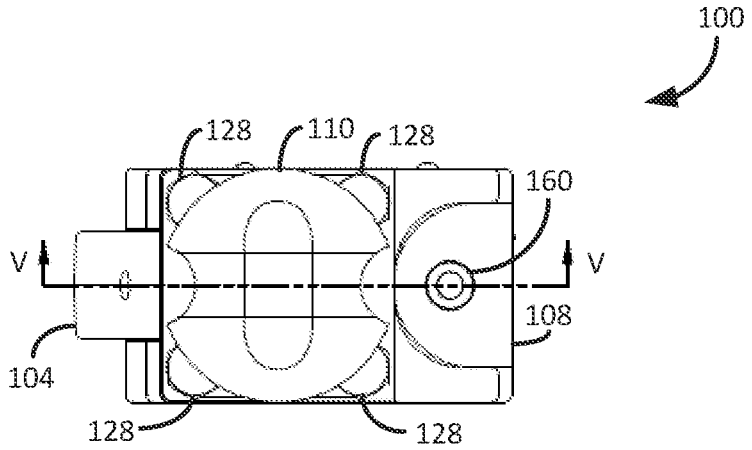
FIG. 3 is a top plan view of the load lifting hook of FIG. 1.
Figure 4:
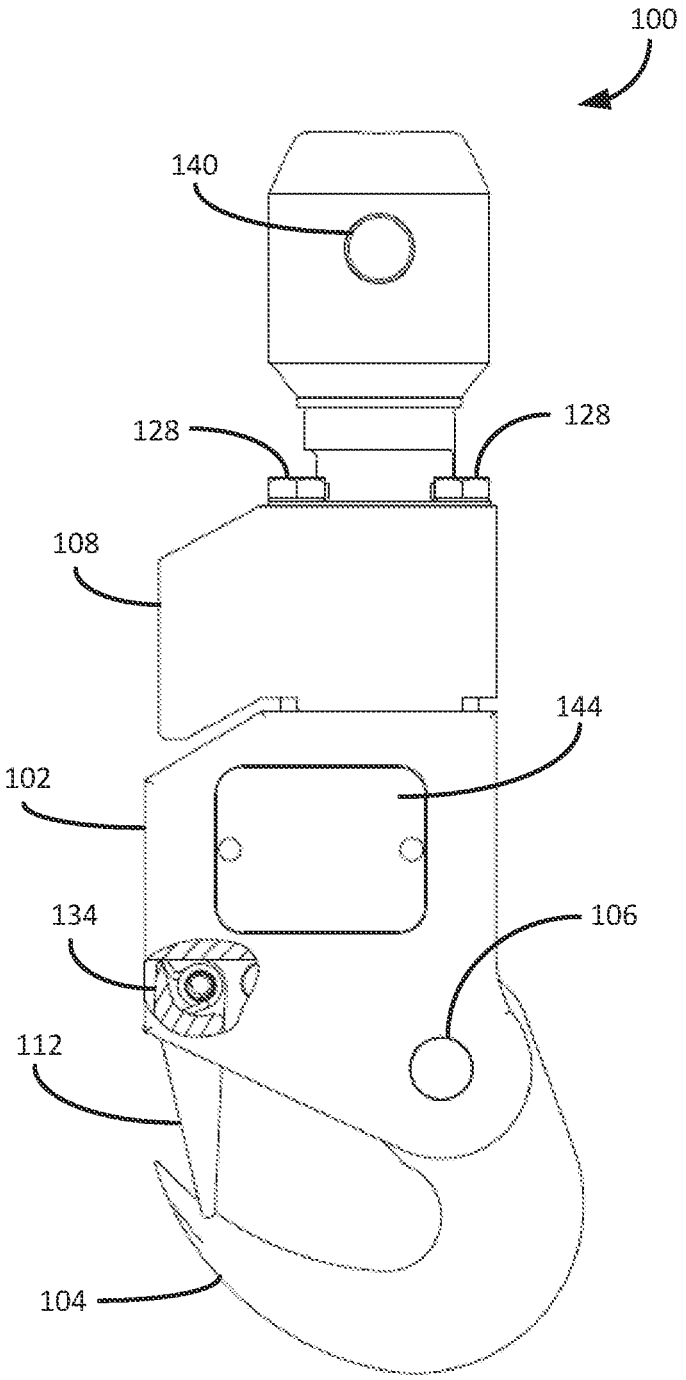
FIG. 4 is a left side elevation view, shown partially in section, of the load lifting hook of FIG. 1.

Described below are implementations of a load lifting hook used for lifting cargo that is releasable by fluid actuation (typically, pneumatic actuation), and has a built-in or integrated pressure relief valve (or other pressure releasing device) configured to vent excess pressure supplied to the load lifting hook to prevent release of the hook under conditions outside of a specified design range(s).

Referring to FIGS. 1-6, a first implementation of the load lifting hook 100 has a body 102 and a hook member 104 pivotably connected to the body 104 at a hook pin 106. In the illustrated implementation, a proximal end of the body 102 is fitted with a removable top cap 108.

Figure 6:
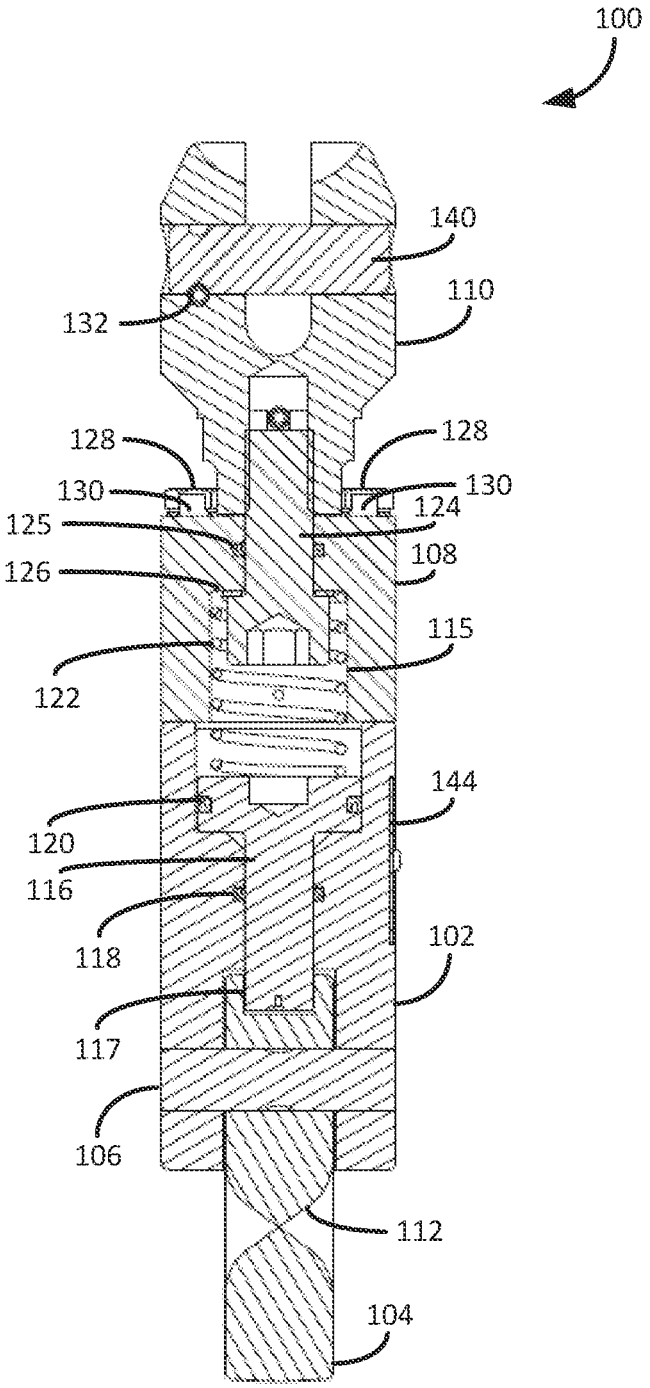
FIG. 6 is a section view in elevation of the load lifting hook taken along the line VI-VI in FIG. 2.

A swivel attachment 110 is coupled to top cap 108. The swivel attachment 110 has a chain pin 140 for coupling the load lifting hook to another rigging component, such as a lifting cable or chain (not shown). The chain pin 140 can be retained by a roll pin 132 (FIG. 6). The swivel attachment 110 can be configured to allow rotation relative to the body 102 over a selected angular range.

The load lifting hook 100 can be fitted with a latch 112 as shown that extends towards the hook 104 to close a throat of the hook 104 when it is the closed position as shown in FIGS. 1-6. The latch 112 can be mounted to the body 102, such as to pivot about a latch pin 114 coupled to the body 102. The latch 112 may be spring biased by a latch spring 134 (FIG. 4) to its closed position as shown in FIGS. 1-6.

Figure 5:
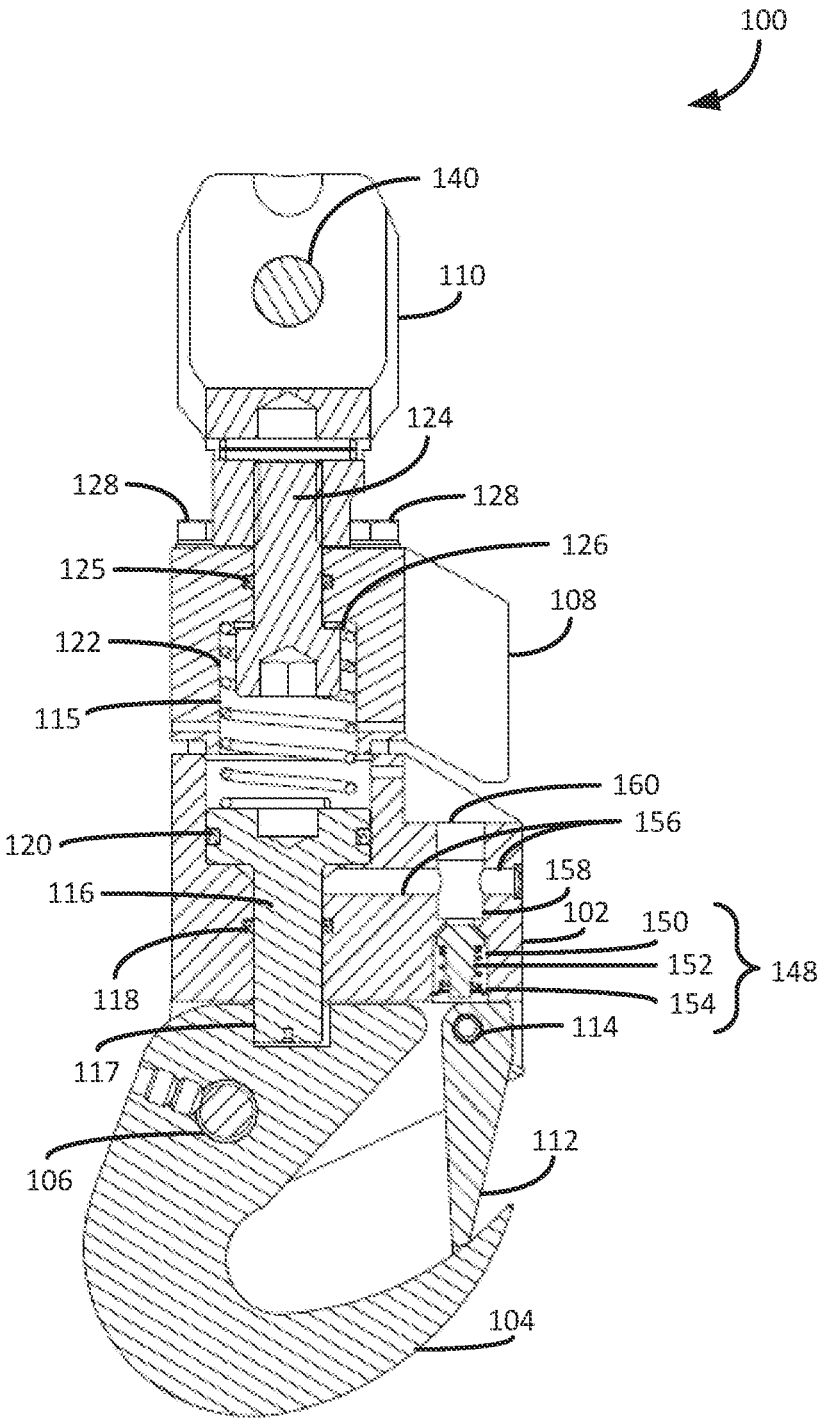
FIG. 5 is a section view in elevation of the load lifting hook taken along the line V-V in FIG. 3.

Referring to the section views of FIGS. 5 and 6 in greater detail, the interior construction of the load lifting hook 100 can be described. A swivel bolt 124, which can be arranged to extend along a body axis of the load lifting hook 100 within an interior recess 115 as shown, couples the swivel attachment 110 to the top cap 108. A swivel bolt washer 126 can be positioned beneath the head of the swivel bolt 124 as shown. The swivel bolt 124 can be adjustable to adjust an angular range over which the swivel attachment 110 can rotate. A seal 125 is provided in a bore for the swivel bolt 124 to seal against debris and water entering into body.

In the illustrated implementation, the top cap 108 is removably coupled to the body 102, such as with the four cap bolts 128. The cap bolts 128 can be fitted with locking tabs 130 (FIG. 6) to prevent inadvertent loosening of the cap bolts 128. In other implementations, a single-piece body construction could be used.

A piston 116 (also sometimes referred to as a "lock member") is arranged within the recess 115 in the body 102. The piston 116 is shown in its extended position "locked" position) with its distal end extending through an end of the body 102 and into a recess 117 of the hook 104, thus locking the hook 104 in the closed position as shown. The piston 116 is spring-biased to the locked position as shown by a spring 122 that is also positioned in the recess 115. There is a seal 118 mounted in a bore to seal a shaft of the piston 116. There is another seal 120 mounted on a head of the piston 116 to seal it within a cylinder portion of the recess 115.

Figure 7:
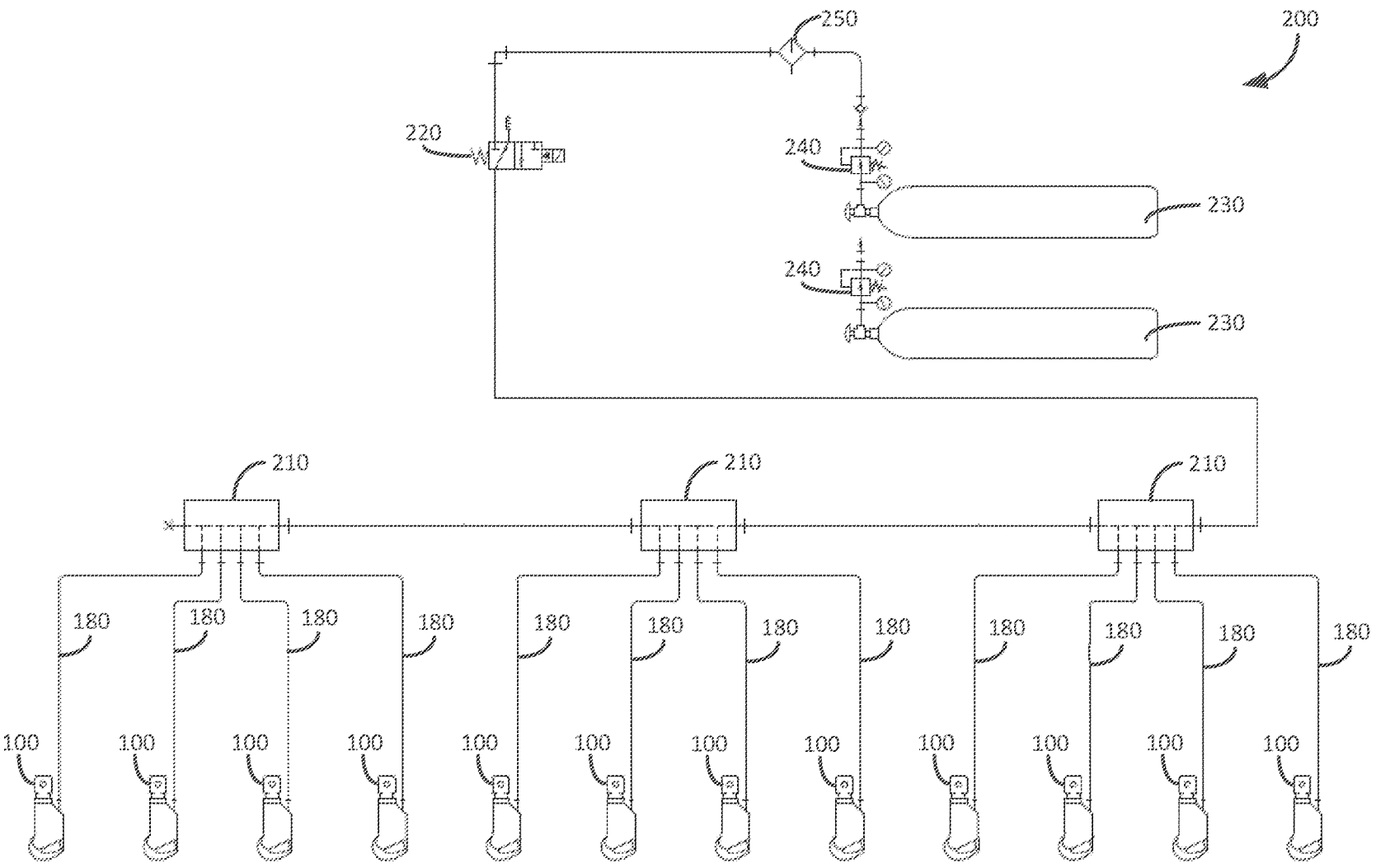
FIG. 7 is a schematic control diagram showing multiple load lifting hooks configured in a load lifting hook system.

In operation, a fluid conduit (such as a conduit 180 as shown in FIG. 7) is connected to the body 102 of the load lifting hook, e.g., at a port opening 160 (FIGS. 1, 3 and 5), to provide pressurized air or other pressurized fluid to operate the piston. The pressurized fluid is supplied to the piston via a supply passageway 156. If the supplied pressure is sufficient to overcome the force of the spring 122, then the piston 116 is urged upward into a retracted position, and the hook 104 moves from the closed position to an open position.

If the pressurized fluid supplied to the load lifting hook is at a supply pressure (e.g., 100 psi) above a predetermined operating pressure for the load lifting hook (e.g., 30-40 psi), then under certain circumstances the piston 116 could be moved and disengaged from the hook 104 while the hook 104 is at least partially loaded. Such circumstances could lead to injury to personnel and damage to the cargo, lifting equipment and surroundings, and thus also disrupt and delay operations.

In the lifting hook 100, however, there is a pressure relief valve 148 that is positioned in communication with the pressurized fluid supplied at 160. In the illustrated implementation, the pressure relief valve 148 is arranged at an end of an exhaust passageway 158 formed in the body 102 that intersects the supply passageway 156. The pressure relief valve 148 exhausts excess supply pressure above the predetermined operating pressure to the atmosphere, thus subjecting the piston 116 to only the operating pressure. As a result, if excess pressure is supplied in an effort to release the hook 104 outside of predetermined conditions, then the excess pressure is exhausted, and the hook 104 will remain locked in the closed position.

The pressure relief valve 148 in the illustrated implementation includes a valve pin 150 that is biased to a closed position by a compression spring 152. The valve pin 150 and the compression spring 152 are secured in place to cover an exhaust opening in the exhaust passageway 158 by a retaining ring 154. The components of the pressure relief valve are recessed from exterior surfaces of the load lifting hook 100 and thus are protected from damage that might occur when the load lifting hook contacts other objects during use. In the illustrated implementation, the pressure relief valve 148 is at least partially hidden by the latch 112. In addition, the pressure relief valve 148 cannot be easily dismantled in the field and thus is tamper-resistant, which keeps the pressure relief valve 148 in service to actively protect personnel and property within traditional industry standards while the load lifting hook 100 is in use.

In one implementation, the pressure relief valve is a Generant VRV-125B-V-35 valve available from Generant Inc. (see www.generant.com), which has a ⅛" port, is made of brass, has a seal made of VITON™, and has a nominal set pressure of 35 psig. In other implementations, any one or more of these valve parameters can be varied to suit specific operating requirements. In addition, in still other implementations, a custom pressure relief valve or other pressure releasing/relief device can be used. For example, in other implementations described below, desired results are achieved with pressure release valves having a nominal set pressure from 20 psi to 40 psi.

In a first example, testing was performed on a conventional (unmodified) Cranston Unihook Model 26A097 to determine a baseline of hook loads and hook release pressures that may cause the hook to open without actuation. A crane scale was installed in the Cranston Hook Pull Test Fixture to determine the weight (force) readings corresponding to the readings of the Hook Pull Test Fixture. The test hook was installed into the Hook Pull Test Fixture. The hook release pressure was then varied over different hook loads, and the results were recorded, noting whether the hook opened or stayed closed (Table 1).

TABLE 1

| Hook Load (PSI) | Release Pressure (PSI) | Hook Release? Yes/No |
|---|---|---|
| 35 lbs (5 psi) | 35 | Yes |
| | 40 | Yes |
| | 45 | Yes |
| | 50 | Yes |
| | 55 | Yes |
| | 60 | Yes |
| 60 lbs (5.5 psi) | 35 | No |
| | 40 | No |
| | 45 | No |
| | 50 | Yes |
| | 55 | Yes |
| | 60 | Yes |
| 80 lbs (6 psi) | 35 | No |
| | 40 | No |
| | 45 | No |
| | 50 | No |
| | 55 | No |
| | 60 | Yes |
| 100 lbs (6.5 psi) | 35 | No |
| | 40 | No |
| | 45 | No |
| | 50 | No |
| | 55 | No |
| | 60 | No |

Thus, as shown in Table 1, the test hook did open at certain combinations of hook load and release pressure, particularly when under the lowest hook load of 35 lbs.

In a second example, testing was conducted using modified hooks having a pressure relief valve. Both a custom designed and manufactured pressure relief valve, as well as a third party purchased pressure relief valve were tested. For the results shown below in Table 2, a Generant VRV-125B-V-35 pressure relief valve was installed in a modified body of a Cranston Unihook, Model 26A097, hook. The pressure relief valve was tested using its factory pre-set release pressure setting of 35 psi. Results were compared to the baseline testing described for hook opening vs. staying closed conditions.

TABLE 2

| Hook Load (PSI) | Release Pressure (PSI) | Hook Release? Yes/No |
|---|---|---|
| 35 lbs (5 psi) | 35 | No |
| | 40 | No |
| | 45 | No |
| | 50 | No |
| | 55 | No |
| | 60 | No |
| 60 lbs (5.5 psi) | 35 | No |
| | 40 | No |
| | 45 | No |
| | 50 | No |
| | 55 | No |
| | 60 | No |
| 80 lbs (6 psi) | 35 | No |
| | 40 | No |
| | 45 | No |
| | 50 | No |
| | 55 | No |
| | 60 | No |

TABLE 2-continued

| Hook Load (PSI) | Release Pressure (PSI) | Hook Release? Yes/No |
|---|---|---|
| 100 lbs (6.5 psi) | 35 | No |
| | 40 | No |
| | 45 | No |
| | 50 | No |
| | 55 | No |
| | 60 | No |

Desirably, the results of Table 2 show that the hook fitted with the pressure release valve did not open under any of the combinations of hook load and release pressure. Thus, the hook fitted with a pressure release valve, and specifically a pressure release valve set at 35 psi, prevented the hook from opening while under load, including the low loads.

In the first and second examples, testing was conducted on a static bench test where the precise pneumatic pressures are applied to maintain an axial lift that is controlled to be exactly vertical.

By way of contrast, in a third example, testing was completed to compare unmodified and modified hooks under a dynamic (live load) condition with a typical overhead hoist and typical shackles, which more closely resembles conditions of actual use in the field.

Desirably, as shown in Table 3 below, the modified hook did not undesirably open except at the lightest live load tested (60 lbs.), and only for the three highest pressures (40 psi, 50 psi and 60 psi). In contrast, the unmodified (conventional) hook opened under at least the highest pressures at all live loads that were tested. Further, the unmodified hook opened at all pressures for the two lightest live loads that were tested. Thus, the modified hook can be fitted with a pressure relief valve having a selected nominal set pressure of 20 psi to 40 psi to achieve desired release operation over a wide range of lifting conditions compared to an unmodified hook.

TABLE 3

| Live Load | Input Pressure | Unmodified Hook without Relief Valve Released? Yes/No | Modified Hook with Pressure Relief Valve Released? Yes/No |
|---|---|---|---|
| 60 lbs* | 20 psi | Yes | No |
| | 30 psi | Yes | No |
| | 40 psi | Yes | Yes |
| | 50 psi | Yes | Yes |
| | 60 psi | Yes | Yes |
| 70 lbs* | 20 psi | Yes | No |
| | 30 psi | Yes | No |
| | 40 psi | Yes | No |
| | 50 psi | Yes | No |
| | 60 psi | Yes | No |
| 80 lbs | 20 psi | No | No |
| | 30 psi | Yes | No |
| | 40 psi | Yes | No |
| | 50 psi | Yes | No |
| | 60 psi | Yes | No |
| 90 lbs | 20 psi | No | No |
| | 30 psi | No | No |
| | 40 psi | Yes | No |
| | 50 psi | Yes | No |
| | 60 psi | Yes | No |
| 100 lbs | 20 psi | No | No |
| | 30 psi | No | No |
| | 40 psi | Yes | No |
| | 50 psi | Yes | No |
| | 60 psi | Yes | No |

FIG. 7 is a schematic diagram of a load lifting hook system 200 with multiple load lifting hooks 100 controlled by an operator at a centralized control station. The centralized control station may be located at some distance, even hundreds of feet (e.g., 300 feet obstructed view up to 1000 ft line of sight), from the load lifting hooks 100, the associated cargo and personnel carrying out the fastening and unfastening of load lifting hooks to and from cargo. As shown in FIG. 7, for a representative system of twelve hooks, groups of four hooks can be connected via their individual conduits 180 to manifolds 210. The manifolds 210, which are interconnected in the illustrated implementation, are in turn connected via a supply line to a solenoid valve 220. The solenoid valve 220 controls the flow of pressurized fluid (such as, e.g., air or nitrogen) to the manifolds 210 and in turn the load lifting hooks 100, thus serving to release and lock and the hooks. The solenoid valve 220 is controlled by an operator, e.g., using a remote radio transmitter with a button or other actuator. The solenoid valve 220 can also be controlled manually, e.g., if a striker plate or other device on the solenoid valve 220 is manually actuated.

The solenoid valve 220 is connected to a pressurized fluid source, such as an air tank 230. In the illustrated implementation, there are two air tanks 230, which are typically configured for use in series with a second of the two tanks being connectable by a quick-connect fitting. Each air tank has an air regulator 240 that is adjustable, typically by the system operator, to adjust the pressure at the air tank 230 at which air or other fluid is supplied. An optional lubricator 250 may be positioned in the circuit to inject oil or other lubricant into the pressurized fluid to lubricate the components of the system 200.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

I claim:

1. A load lifting hook assembly, comprising:

a body;

a hook coupled to the body;

a fluid connection on the body and connectible to a pressurized fluid source;

a piston extendable from the body to engage the hook and lock the hook in a closed position relative to the body, wherein the piston is configured to receive pressurized fluid from the fluid connection tending to urge the piston out of engagement with the hook; and a pressure relief valve in the body positioned in communication with the fluid connection and configured to prevent excess pressure in the pressurized fluid from acting on the piston, wherein the pressure relief valve is configured to vent excess pressure at a selected pressure through an opening in the body to a surrounding area.

2. The load lifting hook of claim 1, wherein the piston is spring-biased to an extended position and the hook comprises a recess shaped to receive the piston when the hook is in a closed position.

3. The load lifting hook of claim 1, wherein the hook comprises a hook body having a base, a hook pivot axis and a distal free end defining a hook point, and wherein the pressure relief valve is positioned in the body opposite the hook point when the hook is in the closed position.

4. The load lifting hook of claim 3, wherein the hook body comprises a hook throat extending from the hook point and across a gap between the hook point and the base of the hook, and where the body comprises a pivotable latch extending away from the body and towards the hook point when the hook is in the closed position.

5. The load lifting hook of claim 4, wherein the pressure relief valve is positioned adjacent the pivotable latch.

6. The load lifting hook of claim 1, wherein the body comprises a passageway, and wherein the pressure relief valve is secured within the passageway with a retaining member.

7. The load lifting hook of claim 1, wherein the pressure relief valve comprises a spring member.

8. The load lifting hook of claim 1, wherein the selected pressure at which the pressure relief valve is configured to vent the excess pressure is selected from a range of 20 psi to 40 psi.

9. The load lifting hook of claim 1, further comprising a swivel arrangement coupled to one end of the body.

10. The load lifting hook of claim 1, further comprising a top cap removably secured to the body.

11. The load lifting hook of claim 1, further comprising a top cap removably coupled to the body, a swivel screw extending from the top cap and connecting to an exterior swivel.

12. The load lifting hook of claim 1, wherein the body defines a body axis and a bore along the body axis dimensioned to receive the piston.

13. The load lifting hook of claim 1, wherein the hook is pivotably coupled to the body.

14. The load lifting hook of claim 1, wherein when the load lifting hook assembly is under a hook load greater than 60 lbs., then the selected pressure at which the pressure relief valve is configured to vent the excess pressure can be selected from a range of 20 psi to 60 psi.

15. A load lifting hook system, comprising:

multiple load lifting hooks;

at least one manifold configured to supply at least two of the multiple load lifting hooks with pressurized fluid via an individual conduit extending to a fluid connection on a body of each load lifting hook, respectively;

a solenoid valve positioned upstream of the at least one manifold;

a pressurized fluid source providing a source of pressurized fluid;

a regulator positioned downstream of the pressurized fluid source, the regulator being adjustable to adjust a supply pressure of the pressurized fluid supplied by the pressurized fluid source; and a pressure relief valve positioned at each of the multiple load lifting hooks and remote from the regulator, wherein the pressure relief valve is selectively configured to vent excess pressure above a predetermined limit pressure that is independent of the supply pressure set by the regulator.

16. The load lifting hook system of claim 15, wherein the pressure relief valve is housed within the body of each load lifting hook in communication with the fluid connection.

17. The load lifting hook system of claim 15, wherein the pressure relief valve is secured in the body with a tamper resistant arrangement.

18. The load lifting hook system of claim 15, wherein the pressure relief valve is non-adjustable.

19. A load lifting hook system, comprising:

a load lifting hook having a fluid connection;

one or more conduit segments connecting the fluid connection of the load lifting hook with a pressurized fluid source providing a source of pressurized fluid;

a solenoid valve positioned upstream of the load lifting hook;

a regulator positioned downstream of the pressurized fluid source, the regulator being adjustable to adjust a supply pressure of the pressurized fluid supplied by the pressurized fluid source; and a pressure relief valve positioned at the load lifting hook and remote from the regulator, wherein the pressure relief valve is selectively configured to vent excess pressure above a predetermined limit pressure that is independent of the supply pressure set by the regulator.

20. The load lifting hook system of claim 19, wherein the pressure relief valve is secured in a body of the load lifting hook with a tamper resistant arrangement and is non-adjustable.

* * * * *